US009464427B2

(12) United States Patent
Karns

(10) Patent No.: US 9,464,427 B2
(45) Date of Patent: Oct. 11, 2016

(54) LIGHT GAUGE STEEL BEAM-TO-COLUMN JOINT WITH YIELDING PANEL ZONE

(71) Applicant: Columbia Insurance Company, Omaha, NE (US)

(72) Inventor: Jesse Karns, Mission Viejo, CA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 14/603,914

(22) Filed: Jan. 23, 2015

(65) Prior Publication Data

US 2016/0215492 A1 Jul. 28, 2016

(51) Int. Cl.

| | |
|---|---|
| ***E04B 1/98*** | (2006.01) |
| ***E04B 1/24*** | (2006.01) |
| ***E04B 2/58*** | (2006.01) |
| ***E04H 9/02*** | (2006.01) |

(52) U.S. Cl.

CPC ..... *E04B 1/2403* (2013.01); *E04B 2/58* (2013.01); *E04H 9/024* (2013.01); *E04B 2001/2418* (2013.01); *E04B 2001/2442* (2013.01); *E04B 2001/2445* (2013.01); *E04B 2001/2448* (2013.01)

(58) Field of Classification Search

CPC ..... E04B 2001/2403; E04B 2001/2406; E04B 2001/2445; E04B 2001/2448; E04B 2001/2451; E04B 2001/249; E04B 1/1903; E04B 1/1912; E04B 2/586

See application file for complete search history.

(56) References Cited

U.S. PATENT DOCUMENTS 1,844,498 A * 2/1932 Candy ..... E04B 1/2403 219/137 R
3,461,636 A * 8/1969 Hern ..... E04B 1/24 52/280

(Continued)

FOREIGN PATENT DOCUMENTS

JP 07150629 A * 6/1995
JP 08281487 A * 10/1996

(Continued)

OTHER PUBLICATIONS

Hardy Frames, Inc. HFX Series, The Hardy Frame® Wall Bracing Method, The Hardy Frame® 9" and 12" wide Panels, 4 pages, 2012, Ventura, California, United States.

(Continued)

*Primary Examiner* — Robert Canfield
(74) *Attorney, Agent, or Firm* — Senniger Powers LLP

(57) ABSTRACT

A beam-to-column joint includes a beam having first and second longitudinal ends and a column including a bottom end and a top end. A panel zone is located adjacent to the first end of the beam, and the top end of the column is attached to the panel zone. The panel zone includes a yielding member and reinforcing structure at least partially bounding the yielding member, the reinforcing structure being configured to concentrate stresses to within the yielding member. The panel zone is configured to resolve external lateral forces on the beam and column into shear force in the yielding member so that the yielding member will fail prior to failure of the beam and column.

18 Claims, 14 Drawing Sheets

(56) References Cited

U.S. PATENT DOCUMENTS 3,716,959 A * 2/1973 Bernardi ..... E04B 1/2403 52/837
3,952,472 A * 4/1976 Boehmig ..... E04B 1/3511 52/655.1
3,971,179 A * 7/1976 Bodocsi ..... E04B 1/24 52/223.11
4,074,947 A * 2/1978 Matake ..... E04B 1/2403 403/189
4,905,436 A * 3/1990 Matsuo ..... E04B 1/215 403/174
5,148,642 A * 9/1992 Plumier ..... E04H 9/02 52/167.1
5,660,017 A * 8/1997 Houghton ..... E04B 1/2403 52/167.3
5,680,738 A * 10/1997 Allen ..... E04B 1/2403 52/653.1
5,913,794 A * 6/1999 Chen ..... E04B 1/2403 52/167.1
6,012,256 A * 1/2000 Aschheim ..... E04B 1/24 52/167.1
6,138,427 A * 10/2000 Houghton ..... E04B 1/2403 52/236.3
6,148,583 A 11/2000 Hardy
6,237,303 B1 * 5/2001 Allen ..... E04B 1/2403 52/653.1
6,412,237 B1 * 7/2002 Sahai ..... E04H 9/02 52/167.1
6,427,393 B1 * 8/2002 Chen ..... E04B 1/2403 403/230
6,591,573 B2 * 7/2003 Houghton ..... E04B 1/2403 52/236.3
6,668,508 B2 12/2003 Boone et al.
6,681,538 B1 * 1/2004 Sarkisian ..... E04B 1/2403 403/335
6,739,099 B2 * 5/2004 Takeuchi ..... E04B 1/2403 403/403
7,000,304 B2 * 2/2006 Sarkisian ..... E04B 1/2403 29/434
7,047,695 B2 * 5/2006 Allen ..... E04B 1/2403 52/120
7,178,296 B2 * 2/2007 Houghton ..... E04B 1/24 52/167.3
7,383,665 B2 * 6/2008 Frobosilo ..... E04B 2/58 52/204.2
7,497,054 B2 * 3/2009 Takeuchi ..... E04B 1/2403 403/403
7,637,076 B2 12/2009 Vaughn
7,832,162 B1 11/2010 Abdel-Rahman et al.
7,849,647 B2 12/2010 Lucey et al.
7,874,120 B2 * 1/2011 Ohata ..... E04B 1/2403 52/653.1
7,900,411 B2 3/2011 Antonic
8,127,502 B2 3/2012 Hulls et al.
8,146,322 B2 * 4/2012 Karns ..... E04B 1/2403 52/653.1
8,205,408 B2 6/2012 Houghton et al.
8,353,135 B2 * 1/2013 Sarkisian ..... E04H 9/02 52/167.3
8,375,652 B2 2/2013 Hiriyur et al.
8,397,445 B2 * 3/2013 Ohnishi ..... E04B 1/24 52/167.1
8,468,775 B2 6/2013 Vaughn
8,511,025 B2 8/2013 Kawai et al.
9,091,065 B2 * 7/2015 Tran ..... E04C 5/162
2002/0100229 A1 * 8/2002 Chen ..... E04B 1/2403 52/167.1
2002/0124520 A1 9/2002 Bock et al.
2003/0009977 A1 * 1/2003 Houghton ..... E04B 1/2403 52/656.9
2004/0010992 A1 * 1/2004 Sarkisian ..... E04B 1/2403 52/289
2004/0244330 A1 * 12/2004 Takeuchi ..... E04B 1/2403 52/831
2004/0247378 A1 * 12/2004 Sarkisian ..... E04B 1/2403 403/83
2005/0204684 A1 * 9/2005 Houghton ..... E04B 1/24 52/653.1
2005/0247007 A1 * 11/2005 Iri ..... E04B 1/24 52/650.1
2006/0144006 A1 * 7/2006 Suzuki ..... E04B 1/2403 52/655.1
2007/0094992 A1 5/2007 Antonic
2007/0289230 A1 12/2007 Schroeder et al.
2008/0148681 A1 * 6/2008 Hiriyur ..... E04B 1/2403 52/690
2008/0289267 A1 * 11/2008 Sarkisian ..... E04H 9/02 52/167.3
2010/0018151 A1 * 1/2010 Hiriyur ..... E04B 1/24 52/656.2
2010/0132286 A1 * 6/2010 Hovey, Jr. ..... E04B 1/24 52/299
2010/0192485 A1 * 8/2010 Sarkisian ..... E04H 9/02 52/167.3
2011/0047889 A1 3/2011 Gad et al.
2011/0194892 A1 * 8/2011 Huang ..... A47B 47/0016 403/296
2011/0296787 A1 12/2011 Pryor et al.
2013/0025222 A1 1/2013 Mueller
2015/0159362 A1 * 6/2015 Pryor ..... E04B 1/2403 52/98

FOREIGN PATENT DOCUMENTS

JP 2000054560 A * 2/2000
JP 2004353419 A * 12/2004
JP 2011208434 A * 10/2011

OTHER PUBLICATIONS

USP Structural Connectors, Hardy Frame, Inc., HFX Series Panels and Brace Frames, pp. 206-209, 2013, Ventura, California, United States.

* cited by examiner

LIGHT GAUGE STEEL BEAM-TO-COLUMN JOINT WITH YIELDING PANEL ZONE

FIELD OF THE INVENTION

The present invention generally relates to building systems, and more specifically, a beam-to-column joint in a light gauge steel assembly for use in a building.

BACKGROUND

Shear walls and moment frames are often used in the construction of buildings. The shear walls and moment frames are configured to handle and transmit forces in a specified manner depending on the desired outcome. Moment frames are typically governed by bending forces. Conventionally, moment frames are not made of light gauge steel because the sections are so thin they will easily buckle and not have a useful bending load capacity. Heavy gauge steel moment frames are seldom used in wood structures because the moment frames are too heavy for the structure. Plywood shear walls are costly and labor intensive to install, and are also subject to variable and unreliable performance because of installation errors.

SUMMARY

In one aspect, a beam-to-column joint comprises a beam including first and second longitudinal ends and a panel zone located adjacent to the first end of the beam. The panel zone includes a yielding member and reinforcing structure at least partially bounding the yielding member. The reinforcing structure is configured to concentrate stresses to within the yielding member. A column includes a bottom end and a top end, the top end of the column being attached to the panel zone. The panel zone is configured to resolve external lateral forces on the beam and column into shear force in the yielding member so that the yielding member will fail prior to failure of the beam and column.

In another aspect, a light weight boxed wall frame comprises first and second columns extending generally parallel to each other in spaced relation. First and second panel zones are attached to the respective first and second columns at top ends thereof. Each of the panel zones includes a yielding member and reinforcing structure at least partially bounding the yielding member, the reinforcing structure being configured to concentrate stresses to within the yielding member. A beam extends between the first and second panel zones and generally perpendicular to the first and second columns. The panel zones are each configured to resolve external lateral forces on the columns and beam into shear force in the panel zones so that the yielding members will yield prior to significant yielding of the beam and the columns.

In yet another aspect, a multi-story boxed wall frame system comprises first and second boxed wall frames, the first boxed wall frame being configured for positioning below the second boxed wall frame. Each boxed wall frame comprises first and second columns extending generally parallel to each other in spaced relation, first and second panel zones attached to the respective first and second columns at top ends thereof, and a beam extending between the first and second panel zones and generally perpendicular to the first and second columns. Each of the panel zones includes yielding members and reinforcing structure at least partially bounding the yielding members, the reinforcing structure configured to concentrate stresses to within the yielding member. The boxed wall frame is configured to resolve external forces into shear force in the yielding member such that the yielding members will yield prior to yielding of the beam and the columns. At least one tie-down rod is configured to extend between and connect the first and second boxed wall frames to each other.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
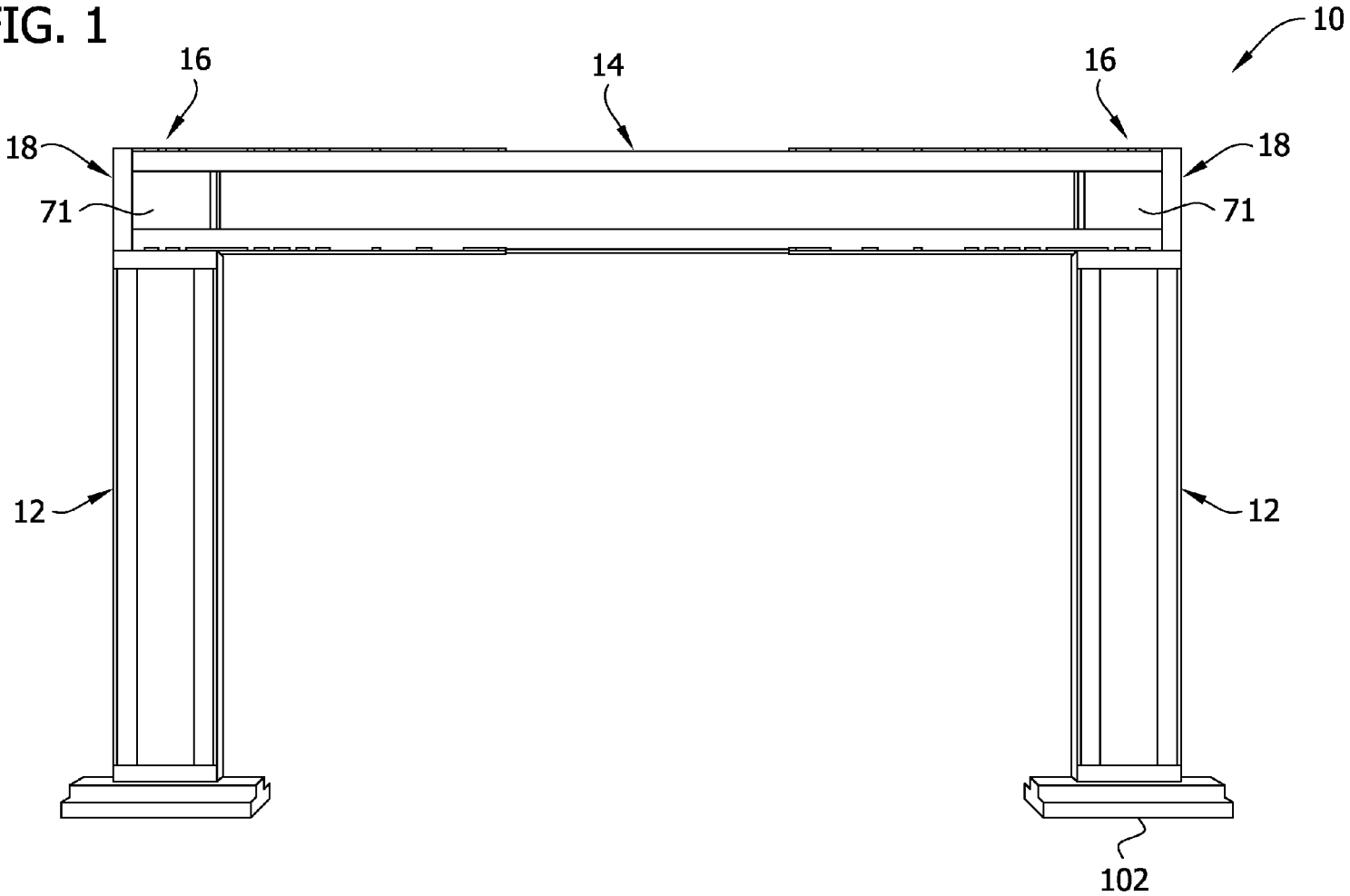
FIG. 1 is a front elevation of an open boxed wall frame including integral yielding panel zones according to an embodiment of the present invention.
Figure 2:
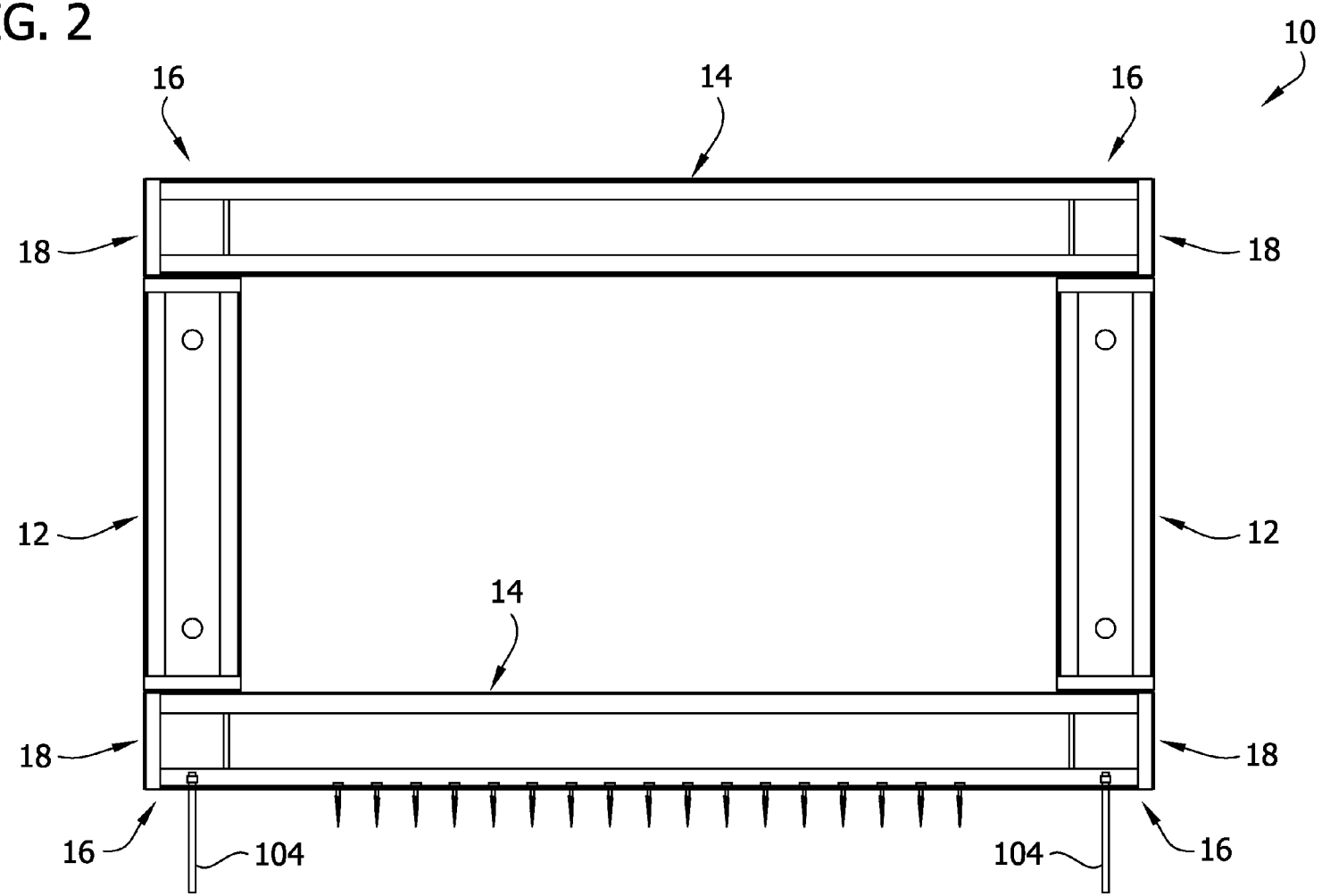
FIG. 2 is a front elevation of a closed boxed wall frame including yielding panel zones.

Referring to FIGS. 1 and 2, a boxed wall frame is generally indicated at 10. The boxed wall frame 10 includes a pair of columns 12 and a beam 14 extending between and joining the columns at beam-to-column joints 16. The boxed wall frame 10 can have other configurations including include a single beam 14 attached to two spaced columns 12 (FIG. 1), or two spaced beams 14 attached to two spaced columns 12 (FIG. 2). Other arrangements of columns and beams may be employed within the scope of the present invention, such as multi-bay configurations or other configurations and combinations of beams and columns. In the illustrated embodiment, each beam-to-column joint 16 includes a panel zone 18 and is configured to develop a specific failure mechanism. In particular, the structure and construction of the beam-to-column joint forces yielding behavior in the panel zone 18 so that the panel zone will absorb energy and fail before the beam 14 or the column 12 fails. As a result, components of the boxed wall frame 10 can be made of lighter weight construction, making them usable in wooden frame buildings to resist horizontal shearing forces (e.g., seismic or wind forces). The panel zone 18 can be formed as part of the beam 14 (FIGS. 1-8) or can be a separate structure attached to the beam (FIGS. 9-13), as will be described in more detail below.

As seen in FIGS. 3-7, the beam 14 is a cold-formed steel beam. The cold-formed steel beam 14 can have any suitable shape or section within the scope of the present invention (e.g., C-section, Z-section, L-section, hat section, I-section, tubular section, rectangular hollow section, angles, etc. and combinations thereof). In the illustrated embodiment, the beam 14 has a generally channel-shaped configuration. The beam 14 includes a rear wall 20, top and bottom walls 22, 24 extending generally perpendicular from the rear wall, and top and bottom front wall portions 26, 28 extending generally perpendicular from the respective top and bottom walls in opposed facing relationship to the rear wall. A beam end channel 30 caps each end of the beam 14. Side stiffeners 32 extend along the top and bottom walls 22, 24 of the beam 14. The side stiffeners 32 can extend continuously along an entire length of the beam 14. The side stiffeners 32 can extend along only portions of the beam 14 (e.g., along portions adjacent the ends of the beam as illustrated in the drawings). The side stiffeners 32 are preferably attached by welds 34 to the top and bottom walls 22, 24 of the beam 14, although other attachment configurations are within the scope of the present invention. It is understood that the side stiffeners can be omitted within the scope of the present invention. Similarly, the column 12 is a cold-formed steel column. The cold-formed steel column 12 can have any suitable shape or section within the scope of the present invention (e.g., C-section, Z-section, L-section, hat section, I-section, tubular section, rectangular hollow section, angles, etc. and combinations thereof). In the illustrated embodiment, the column 12 has a generally channel-shaped configuration. The column 12 includes a rear wall 40, first and second side walls 42, 44 extending generally perpendicular from the rear wall, and first and second front wall portions 46, 48 extending generally perpendicular from the respective first and second side walls in opposed facing relationship to the rear wall. A column end channel 50 caps each end of the column 12. Side stiffeners 52 extend along the first and second side walls 42, 44 of the column 12. The side stiffeners 52 can extend continuously along an entire length of the column 12 or along only portions of the column as is illustrated. The side stiffeners 52 are preferably attached by welds 54 to the first and second side walls 42, 44 of the column 12, although other attachment configurations are within the scope of the present invention. It is understood that the side stiffeners can be omitted within the scope of the present invention. The beam 14 and column 12 are preferably formed of light gauge steel, such as 25-10 gauge steel. The side stiffeners 32, 52 are preferably metal plates (e.g., steel plates) having a thickness in the range of about ⅛" to about ⅜", but may be formed of light gauge material or any other suitable material.

Figure 3:
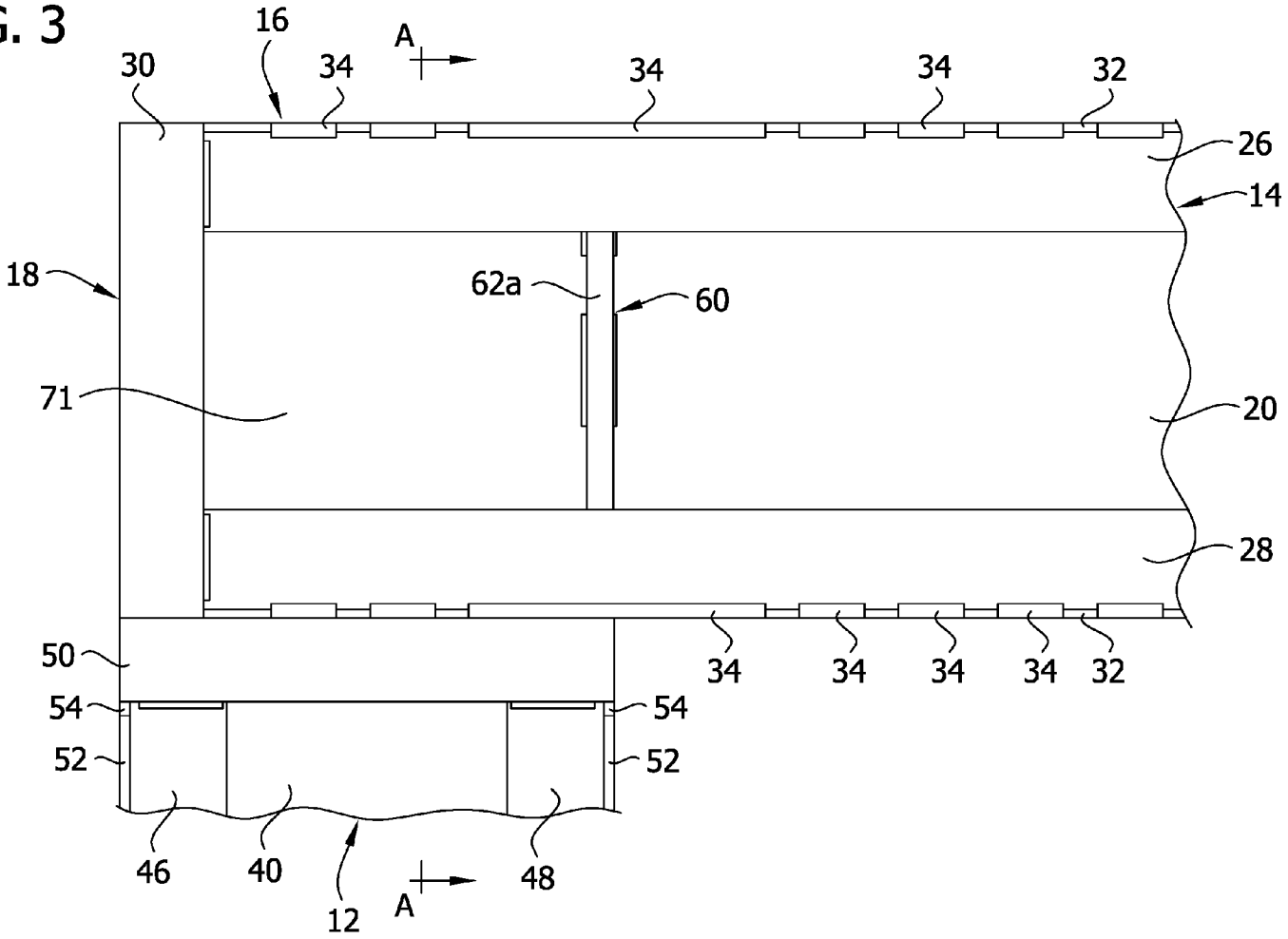
FIG. 3 is an enlarged, fragmentary front elevation of a beam-to-column joint of the boxed wall frame.
Figure 4:
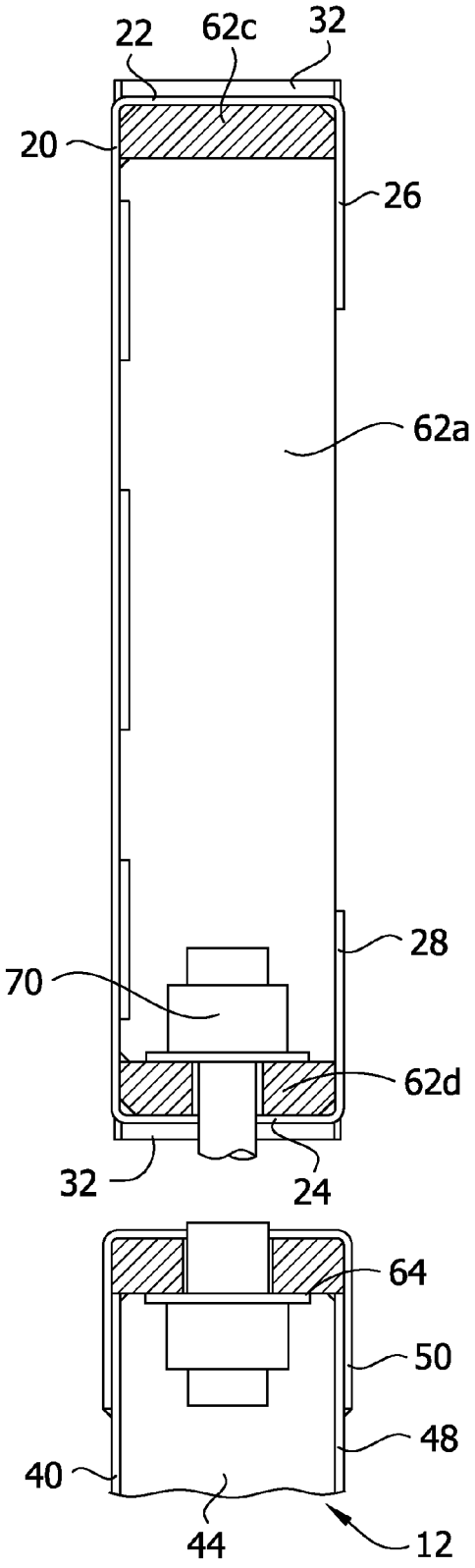
FIG. 4 is a section taken in a plane including line A-A of FIG. 3.
Figure 5:
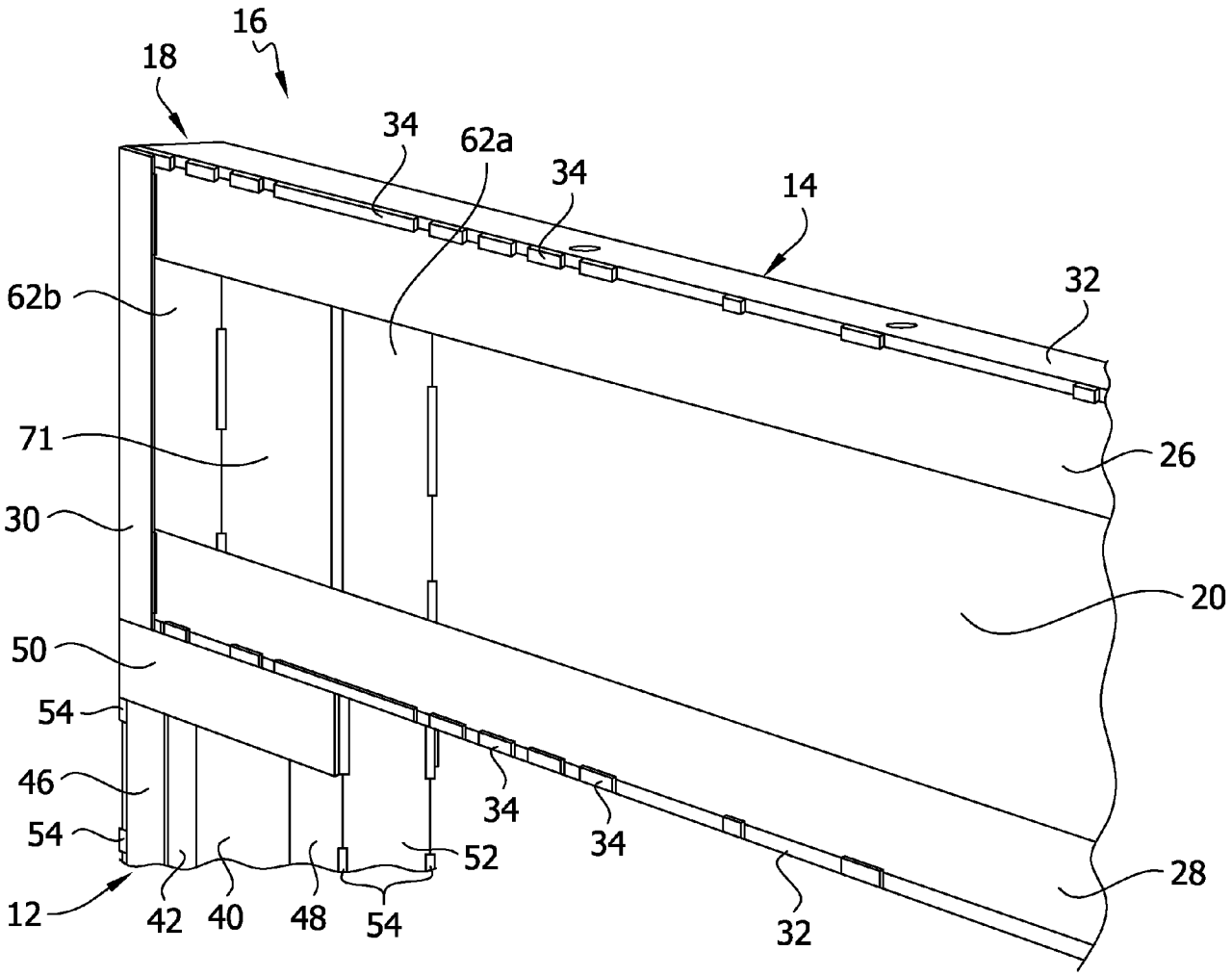
FIG. 5 is a right side perspective of the beam-to-column joint of FIG. 3.
Figure 6:
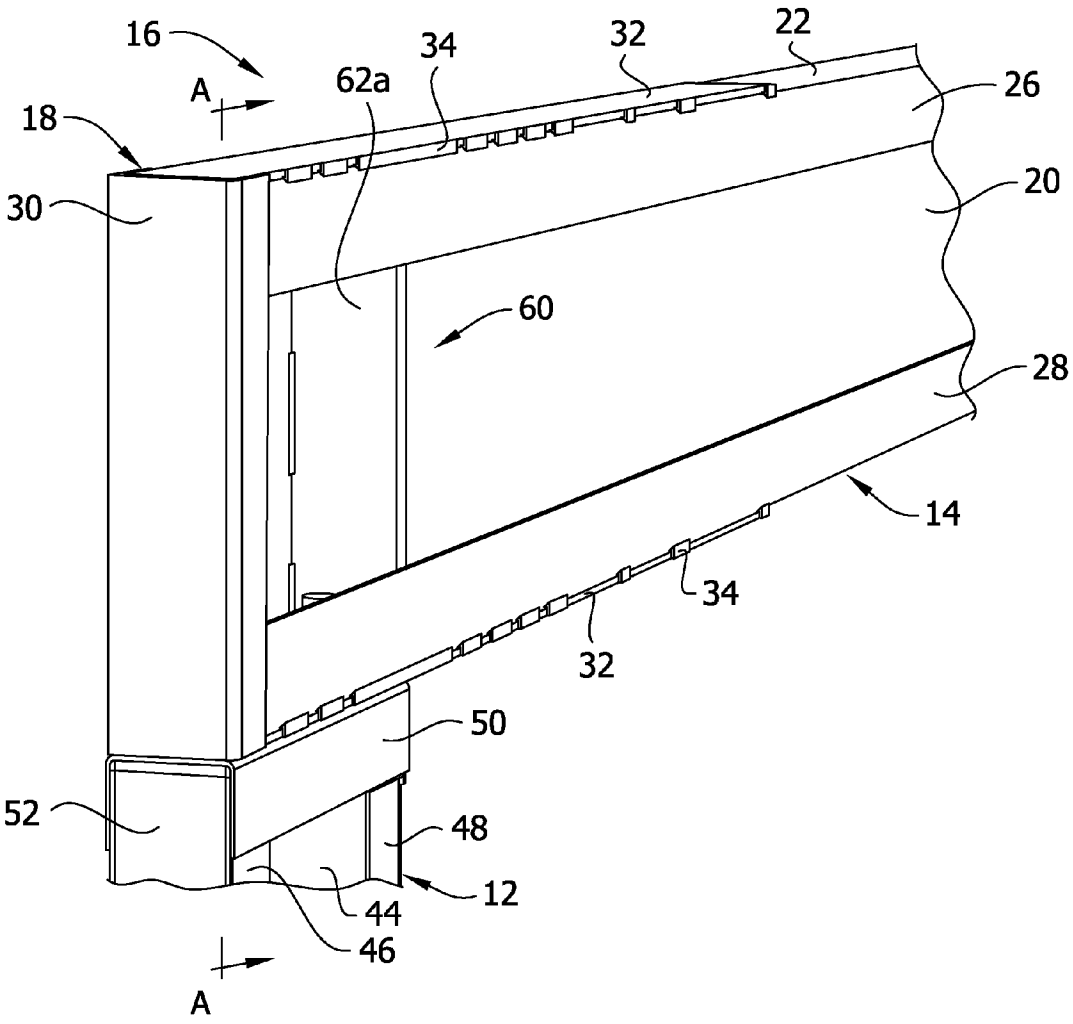
FIG. 6 is a left side perspective of the beam-to-column joint of FIG. 3.
Figure 7:
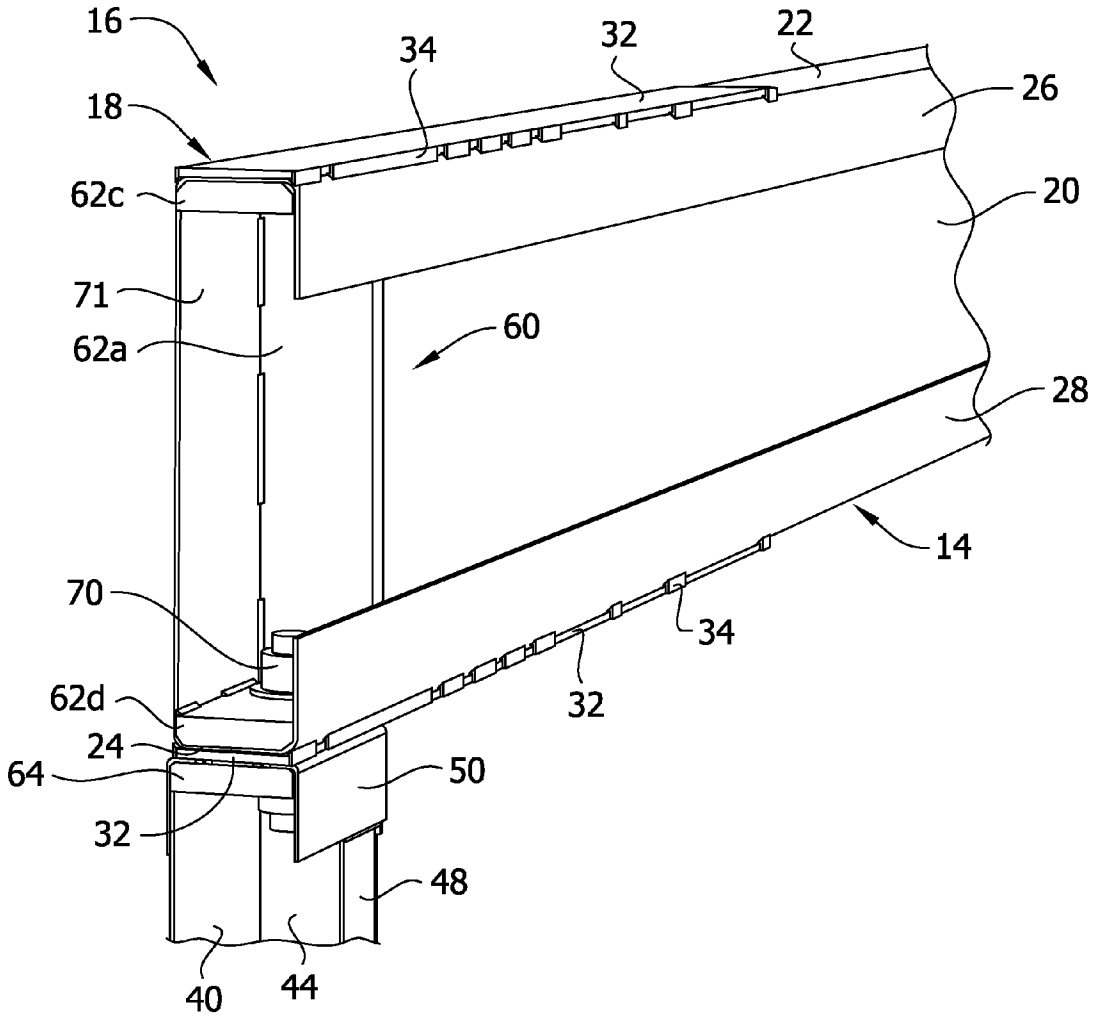
FIG. 7 is a section taken in a plane including line A-A of FIG. 6.

Referring still to FIGS. 3-7, in a first embodiment the panel zone 18 is formed integrally with the beam 14 at an end thereof. The panel zone includes reinforcing structure 60 configured to direct stresses within the panel zone 18. The panel zone is at least partially bounded by the reinforcing structure 60. As illustrated, the reinforcing structure 60 includes multiple internal stiffeners 62*a-d* bounding the panel zone 18. As seen in FIG. 3, a first internal stiffener 62*a* extends between the top and bottom walls 22, 24 of the beam 14 at a location spaced from the end of the beam and generally aligned with the second side wall 44 of the column 12. A second internal stiffener 62*b* extends between the top and bottom walls 22, 24 of the beam 14 at the end of the beam, generally aligned with the first side wall 42 of the column 12. A third internal stiffener 62*c* extends along the top wall 22 of the beam 14 in a direction between the first and second internal stiffeners 62*a*, 62*b*, and a fourth internal stiffener 62*d* extends along the bottom wall 24 of the beam in a direction between the first and second internal stiffeners. In the illustrated embodiment, the third and fourth internal stiffeners 62*c*, 62*d* extend between the first and second internal stiffeners 62*a*, 62*b*. In one embodiment, the internal stiffeners 62*c*, 62*d* can extend beyond the first internal stiffener 62*a*, such as by a distance of up to about 6 inches (not shown). This configuration provides additional strength to prevent bending failure in the beam 14, and also facilitates using angles or plates to attach the beam to the column 12. The internal stiffeners 62*a-d* are preferably metal plates (e.g., steel plates) or metal shapes (e.g., channel, angle, tube) having a thickness required to force shear yielding of the panel zone 18. In one embodiment, the internal stiffeners are metal plates having a thickness in the range of about ⅛" to about 1", such as about ¾". The internal stiffeners 62*a-d* are connected to the beam 14, such as by stitch welding. In addition, the internal stiffeners 62*a-d* can be connected (e.g., welded) to each other. Optionally, the column 12 can also include an internal stiffener 64 extending between the first and second side walls 42, 44 adjacent the column end channel 50. The internal stiffener 64 is connected to the column 12, such as by stitch welding. The internal stiffener 64 is generally aligned with the internal stiffener 62*d* extending along the bottom wall 24 of the beam 14.

The beam 14 is attached to the column 12 with at least one fastener, such as attachment bolts 70. The attachment bolts extend through the bottom wall 24 of the beam 14 and the column end channel 50 to attach the beam to the column 12. The attachment bolts 70 also extend through the internal stiffeners 62*d*, 64 positioned adjacent the bottom wall 24 and the column end channel 50. The bottom wall 24 of the beam, the column end channel 50, and the internal stiffeners 62*d*, 64 can include openings configured to receive the bolts 70. The bolts 70 are preferably high strength bolts, such as ¾" to 1½" bolts. In one embodiment, the bolts 70 are 1⅛" bolts. Other connection configurations and structures for attaching the beam 14 to the column 12 (not shown) are within the scope of the present invention, such as angles and/or plates welded and/or bolted to the beam and the column.

Figure 8:
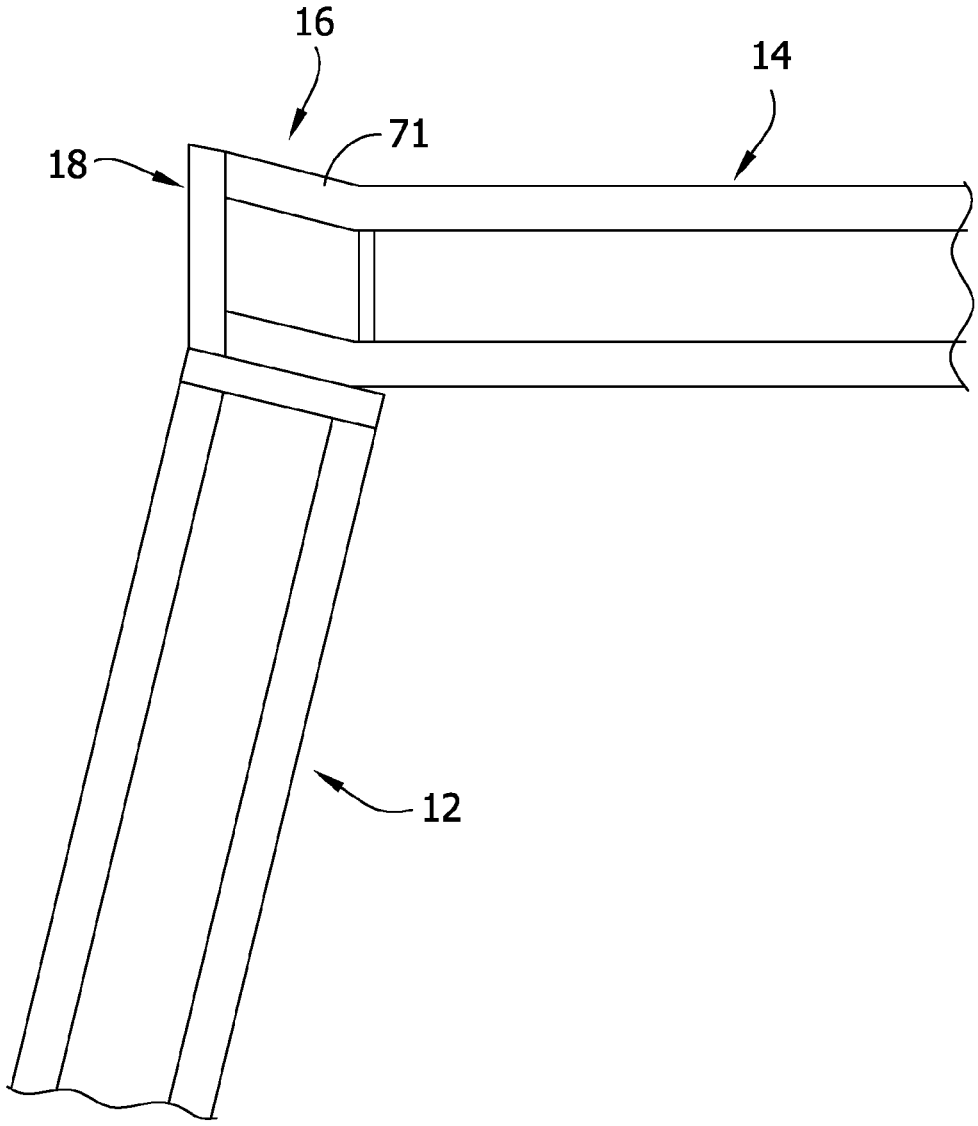
FIG. 8 is a fragmentary front elevation illustrating a deformed state of the beam-to-column joint of FIG. 3.
Figure 9:
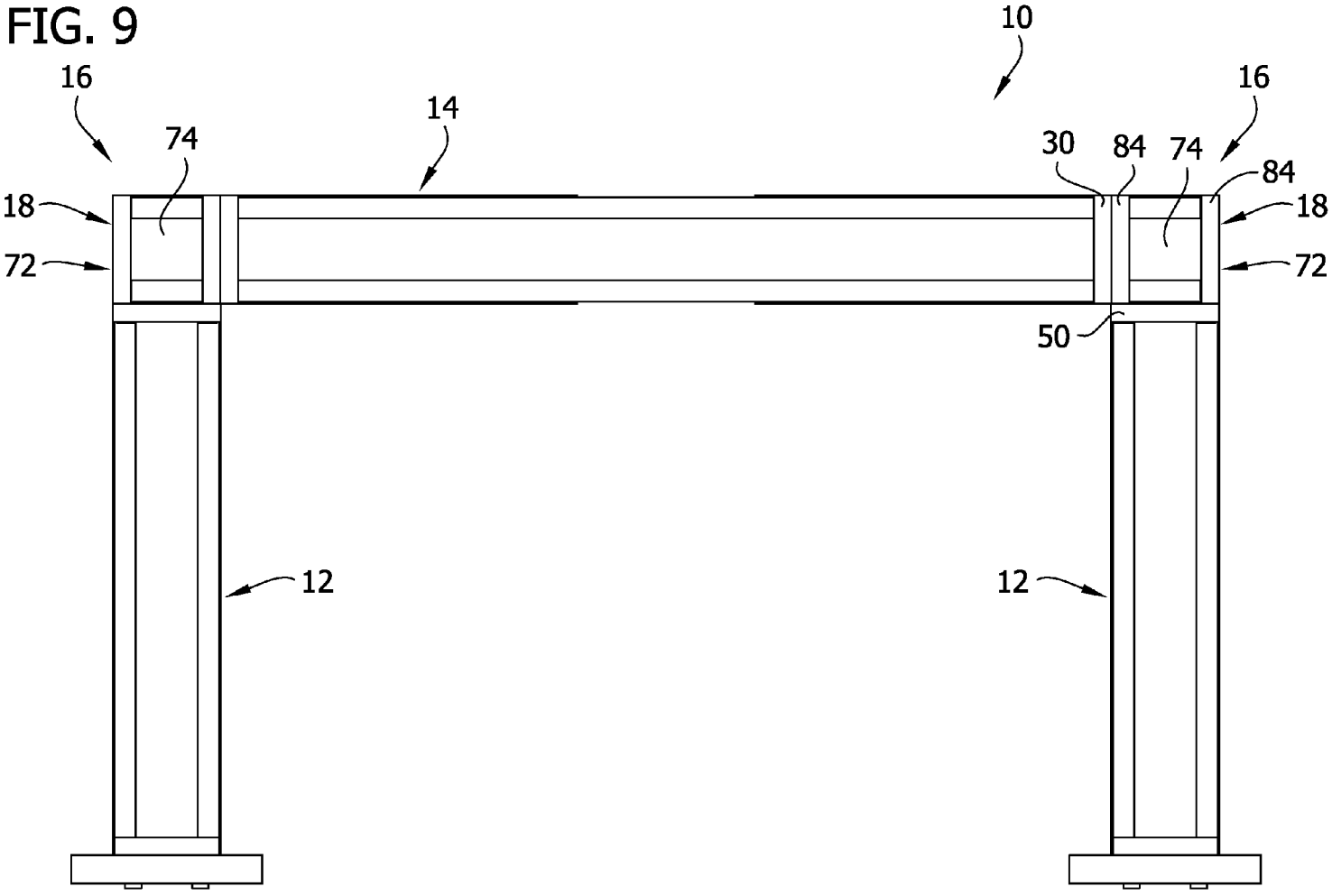
FIG. 9 is a front elevation of a boxed wall frame with separately formed panel zone structures according to an embodiment of the present invention.
Figure 10:
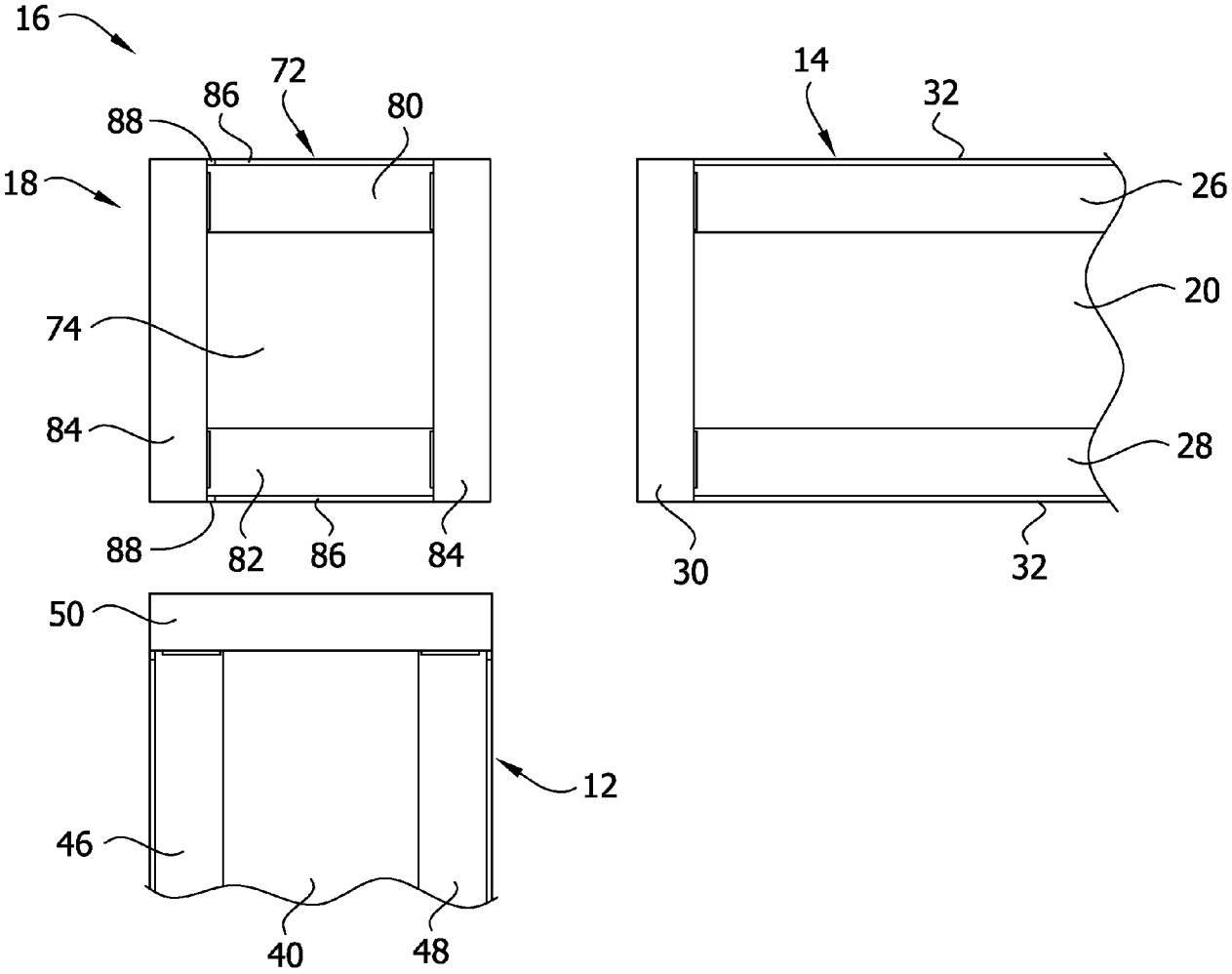
FIG. 10 is a fragmentary exploded front elevation of a beam-to-column joint with separately formed panel zone structure.
Figure 11:
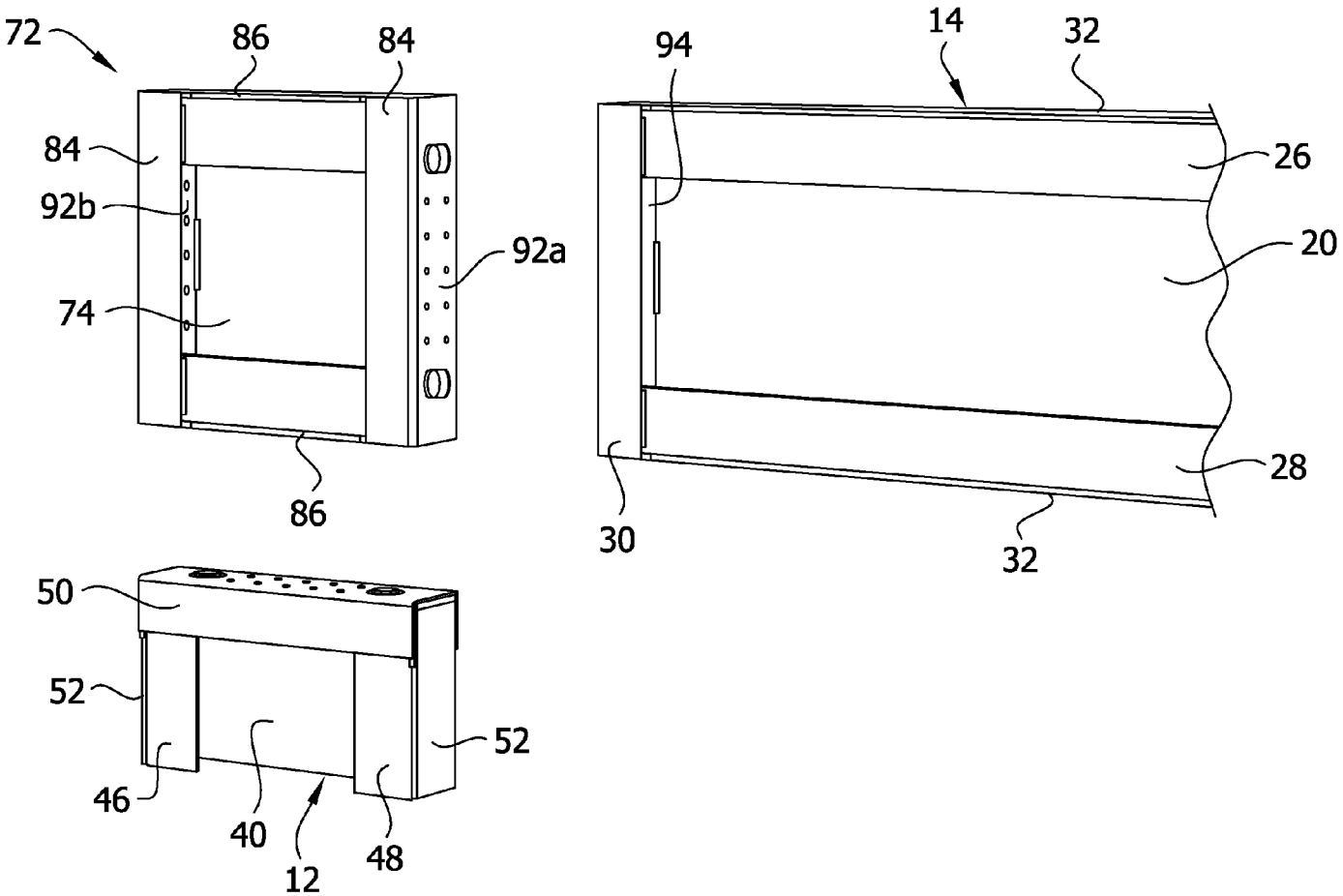
FIG. 11 is a right side perspective of the beam-to-column of FIG. 9.
Figure 12:
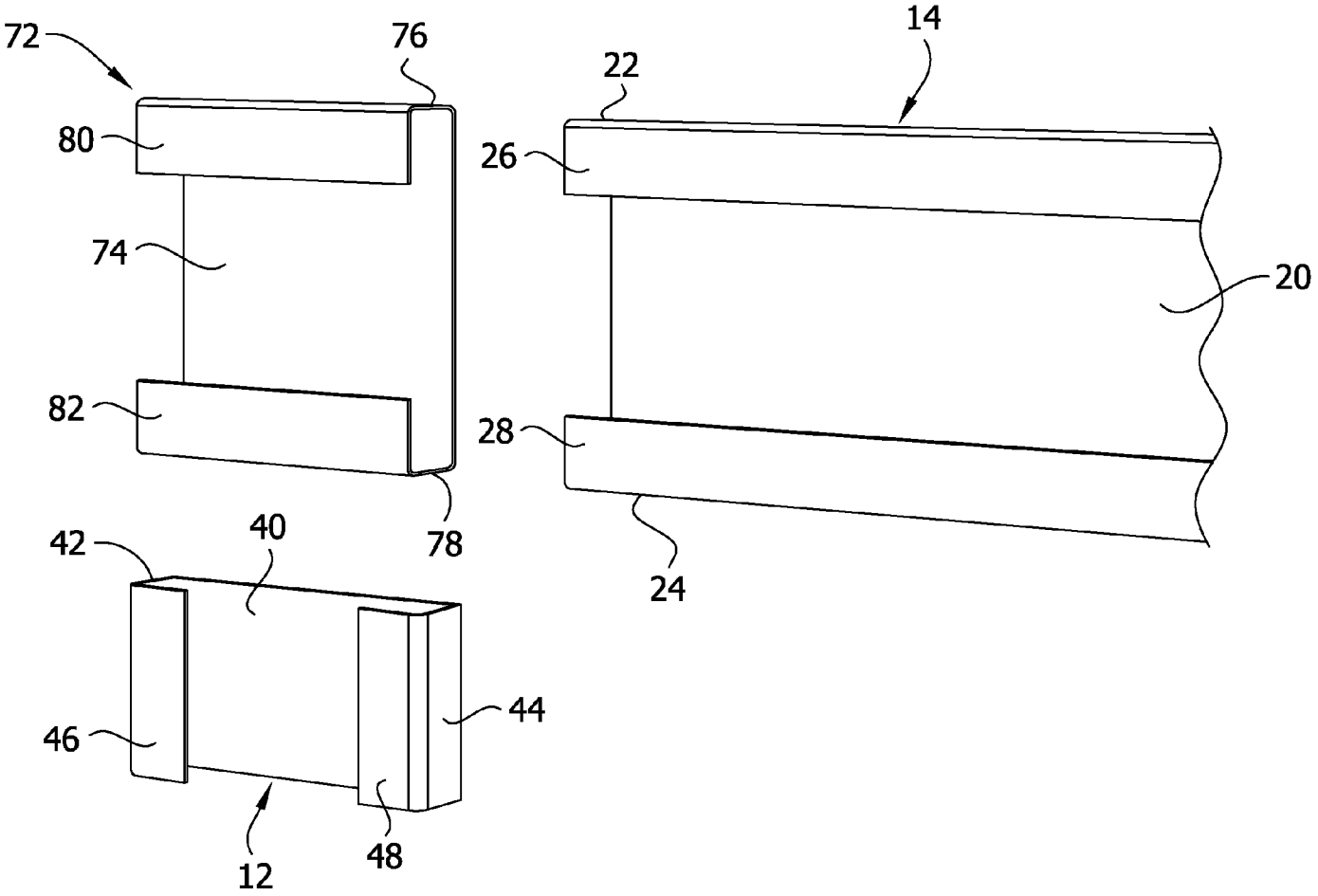
FIG. 12 is a view similar to FIG. 10, but illustrating only a panel of the panel zone structure, beam, and column of the beam-to-column joint of FIG. 10.

In general, a structure is subjected to horizontal loads (e.g., seismic, wind) and vertical loads (e.g., gravity). Failures due to lateral or horizontal loads can be tolerated to some degree, but failures in the vertical or gravity support can cause the entire structure to collapse. The beam-to-column joint 16 is configured to yield to dissipate energy due to horizontal loads while still maintaining the ability to carry the vertical load. The beam-to-column joint 16 including the panel zone 18 forces specific behavior of the beam 14 and column 12. The configuration of the beam and column assembly forces ductile behavior in a specific location (the panel zone 18) to dissipate energy and reduce the potential for failure of the entire assembly. Yielding occurs in the panel zone 18 before yielding or failure of the beam 14 or column 12. Specifically, a yielding member or panel 71 comprising a portion of the rear wall 20 generally bounded by the stiffeners 62*a*, 62*b*, 62*c*, 62*d* will fail prior to failure of the column or beam, while the panel zone 18 remains sufficiently intact because of the stiffeners to support the weight of the building. External stresses (e.g., horizontal loads) acting on the beam and column assembly are resolved into shear forces in the panel 71. When the beam and column assembly is subjected to external forces, a tension-compression couple creates a moment in the beam. The couple is resolved in the panel 71 as shearing force and loads are transferred into the column to be transferred into the foundation of a building to which the assembly is attached. The beam 14 and column 12 are configured to have a bending capacity that is high enough to force the desired failure mechanism in the panel 71 within the panel zone 18. The panel 71 will yield to dissipate energy before the beam or column reaches the bending capacity (i.e., the panel 71 will yield before either the beam or column significantly yields). Even though portions of the beam and/or column may yield locally (i.e., some of the material may yield), the entire element (the beam or column) does not yield (i.e., the beam or column does not significantly yield). The panel 71 yields to dissipate energy before either the beam or column yields in a fashion to prevent performance of the gravity function of the beam/column. For example, a deformed state of the beam-to-column joint is illustrated in FIG. 8. In the deformed state, the panel 71 within the panel zone 18 has yielded (i.e., the panel zone portion has buckled, as shown), and the beam 14 and column 12 remain intact. The internal stiffeners, the beam, and/or the column may locally yield in bending as the shear deformations in the panel zone get sufficiently large, but failure of the entire element is prevented. Upon yielding of the panel 71, the beam and column assembly can continue to resist or hold the vertical building or gravity load it had (i.e., catastrophic failure is prevented). In comparison, if the beam or column were to buckle, the system would lose its entire capacity and would fail catastrophically, causing for example all or a portion of a building to collapse. Thus, the construction configured to force failure in the panel zone 18 localizes failure to an area that does not affect the gravity support of the building structure and permits the assembly to continue to support its load, thereby preventing catastrophic failure. Although the yielding member is illustrated as a panel 71, it may have other constructions without departing from the scope of the present invention.

In the embodiment of FIGS. 9-13, the panel zone 18 comprises a distinct panel zone structure 72 attached to the column 12 and the beam 14. The panel zone structure 72 includes a panel 74, top and bottom walls 76, 78 extending generally perpendicular from the panel, and top and bottom front wall portions 80, 82 extending generally perpendicular from the respective top and bottom walls in opposed facing relationship to the panel. An end channel 84 caps each end of the panel zone structure 72. Side stiffeners 86 extend along all or a portion of the top and bottom walls 76, 78 of the panel zone structure 72. The side stiffeners 86 are preferably attached by welds 88 to the top and bottom walls 76, 78 of the panel zone structure 72, although other attachment configurations are within the scope of the present invention. The panel zone structure 72 is preferably formed of light gauge steel, such as 25-10 gauge steel. The side stiffeners 86 are preferably metal plates (e.g., steel plates) having a thickness in the range of about ⅛" to about ⅜", but may be formed of light gauge material or any other suitable material.

Figure 13:
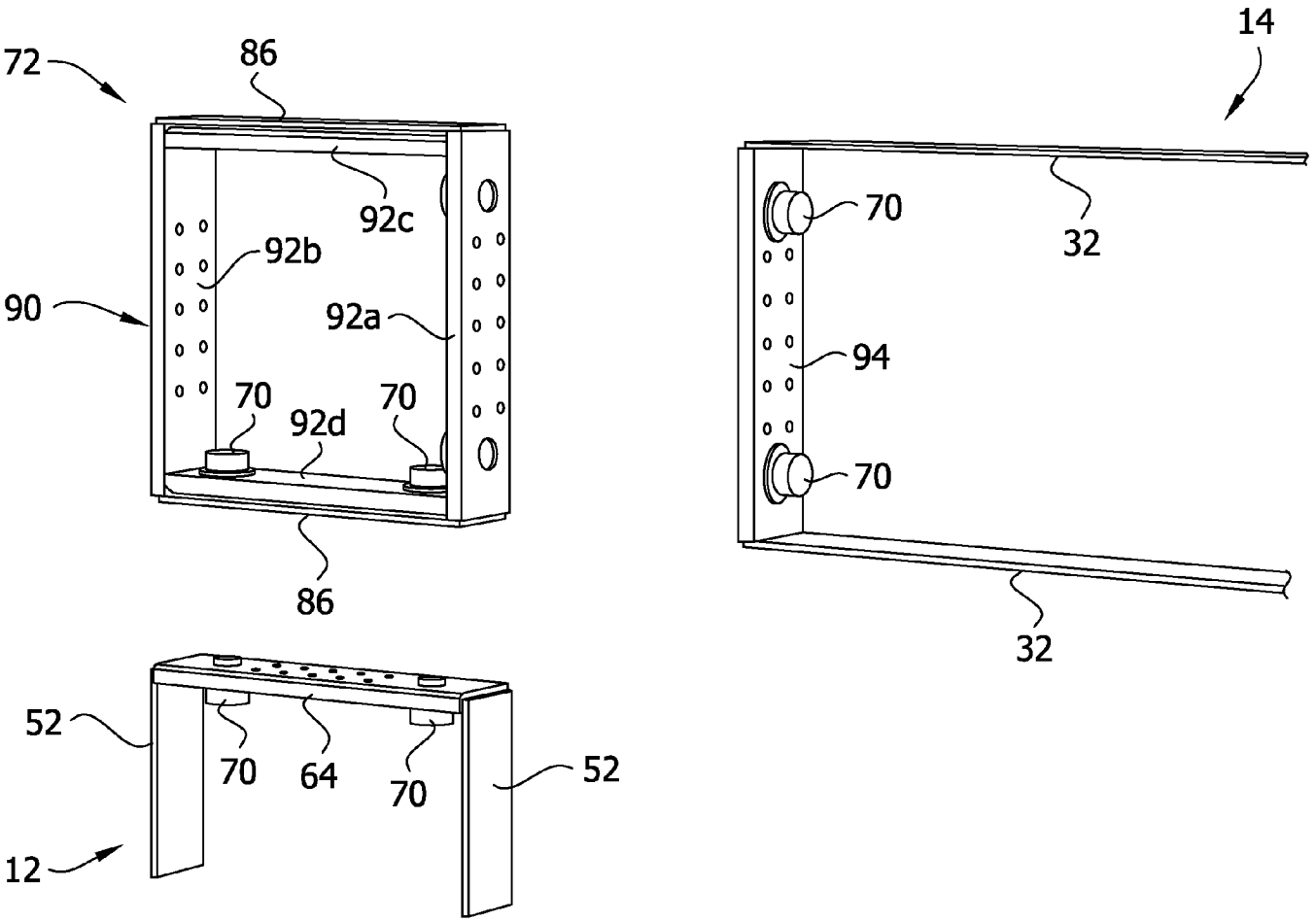
FIG. 13 is a view similar to FIG. 10, but illustrating only side stiffeners and a reinforcing structure of the beam-to-column joint of FIG. 10.

The panel zone structure 72 includes reinforcing structure 90 configured to concentrate stresses within the panel zone structure. The panel 74 is at least partially bounded by the reinforcing structure 90. As seen in FIG. 13, the reinforcing structure 90 includes at least one internal stiffener 92*a-d* extending between the top and bottom walls 76, 78 of the panel zone structure 72. As illustrated, the panel zone structure 72 includes an internal stiffener 92*a-d* on each side of the panel 74. A first internal stiffener 92*a* extends between the top and bottom walls 76, 78 of the panel zone structure 72 adjacent one of the end channels 84, and a second internal stiffener 92*b* extends between the top and bottom walls of the panel zone structure adjacent the other end channel. The first internal stiffener 92*a* is generally aligned with the second side wall 44 of the column 12. The second internal stiffener 92*b* is generally aligned with the first side wall 42 of the column 12. A third internal stiffener 92*c* extends along the top wall 76 of the panel zone structure 72 between the first and second internal stiffeners 92*a*, 92*b*, and a fourth internal stiffener 92*d* extends along the bottom wall 78 of the panel zone structure between the first and second internal stiffeners. The internal stiffeners 92*a-d* are preferably metal plates (e.g., steel plates) or metal shapes (e.g., channel, angle, tube) having a thickness required to force shear yielding of the panel zone 18. In one embodiment, the internal stiffeners are metal plates having a thickness in the range of about ⅛" to about 1", such as about ¾". The internal stiffeners 92*a-d* are connected to the panel 74, such as by stitch welding. In addition, the internal stiffeners 92*a-d* can be connected (e.g., welded) to each other and/or connected (e.g., welded) to the end channels 84. Other configurations of the panel zone structure (not shown) are within the scope of the present invention. For example, the panel zone structure can comprise stiffeners (e.g., plates, tubes, channels, angles) and a yielding member comprising a light gauge steel rear wall (e.g., steel sheet, C-channel) attached to the stiffeners.

In the illustrated embodiment, the column 12 includes the internal stiffener 64 extending between the first and second side walls 42, 44 adjacent the column end channel 50, as described above. The internal stiffener 64 is connected to the column 12, such as by stitch welding. The internal stiffener 64 can also be connected (e.g., welded) to the column end channel 50. The internal stiffener 64 is generally aligned with the internal stiffener 92*d* extending along the bottom wall 78 of the panel zone structure 72 when the panel zone structure, beam 14, and column 12 are attached. The beam 14 includes an internal stiffener 94 extending between the top and bottom walls 24, 26 adjacent the beam end channel 30. The internal stiffener 94 is connected to the beam 14, such as by stitch welding. The internal stiffener 94 is generally aligned with the internal stiffener 92*a* extending along the end channel 84.

The panel zone structure 72 is attached to the column 12 and to the beam 14 with fasteners, such as the attachment bolts 70. The attachment bolts extend through the end channel 84 and the beam end channel 30 to attach the panel zone structure 72 to the beam 14. The attachment bolts 70 connecting the panel zone structure 72 to the beam 14 also extend through the internal stiffeners 92*a*, 94 positioned adjacent the respective end channels 30, 84. Attachment bolts 70 extend through the bottom wall 78 of the panel zone structure 72 and the column end channel 50 to attach the panel zone structure to the column 12. The attachment bolts 70 connecting the panel zone structure 72 to the column 12 also extend through the internal stiffeners 92*d*, 64 positioned adjacent the panel zone structure bottom wall 78 and the column end channel 50. With the beam and column assembly attached as described, the beam 14 is attached to the column 12 via the panel zone structure 72. The bottom wall 78 of the panel zone structure 72, the end channel 84, the beam end channel 30, the column end channel 50, and the internal stiffeners 64, 92*a*, 92*d*, 94 can include openings configured to receive the bolts 70. As described above, the bolts 70 are preferably high strength bolts, such as ¾" to 1½" bolts. In one embodiment, the bolts 70 are 1⅛" bolts. Other connection configurations and structures for attaching the beam 14, the column 12, and the panel zone structure 72 are within the scope of the present invention, such as angles and/or plates welded and/or bolted to the beam, column, and panel zone structure.

As with the first embodiment described above, the beam-to-column joint including the separately formed panel zone structure 72 forces specific behavior of the beam and column assembly. Specifically, the panel zone structure 72 will yield to dissipate energy before significant yielding or failure of the beam 14 or column 12. External forces acting on the beam and column assembly are resolved in the panel zone structure 72 and specifically in the panel 74 as shear force. The external forces acting on the column (e.g., wind, seismic, etc.) create a moment in the beam 14 that is resolved in the panel zone structure 72 into shear force in the panel 74.

Referring to FIGS. 1 and 2, the boxed wall frame 10 includes a beam-to-column joint 16 including a panel zone 18 at each corner of the wall frame. In the embodiment of FIG. 1, the boxed wall frame 10 includes one beam 14 attached to two spaced columns 12 at two beam-to-column joints 16. This type of boxed wall frame 10 can be referred to as an 'open' boxed wall frame, as one side of the frame is left open (i.e., there is no second beam closing the bottom side of the 'box'). In the embodiment of FIG. 2, the boxed wall frame 10 includes two beams 14 attached to two spaced columns 12 at four beam-to-column joints 16. This type of boxed wall frame 10 can be referred to as a 'closed' boxed wall frame, as the frame is closed (i.e., there is a second beam closing the bottom side of the 'box'). In each embodiment, a beam-to-column joint 16 as described above joins the beams 14 to the columns 12 (i.e., the boxed wall frame 10 includes a panel zone 18 at each juncture of a beam and a column). For example, if the panel zone 18 is integral with the beam 14, each beam in the boxed wall frame 10 includes a panel zone at each end of the beam. If the panel zone 18 is in a separate panel zone structure 72, a panel zone structure is attached to each end of each beam 14. The boxed wall frame 10 thus includes a panel zone 18 at each corner and is thereby configured to force a specific yielding or failure behavior, as described above. In particular, the panel zones 18 will yield or fail before yielding or failure of any of the beams 14 or columns 12 in the boxed wall frame 10.

The boxed wall frame 10 can be sold and shipped to customers as a disassembled kit, including at least one beam 14, at least one column 12, at least one panel zone 18 (which can either be a separate panel zone structure 72 or can be integral with the beam, as described above), and attachment bolts 70 for attaching the beam to the column. Alternatively, the boxed wall frame 10 can be sold and shipped to customers as an assembled frame (e.g., as seen in FIGS. 1 and 2).

The boxed wall frame 10 including panel zones 18 as described above is useful in residential construction, such as single family and multi-family residences. Multiple boxed wall frames 10 including the described beam-to-column joints 16 can be used in the construction of a building. If the boxed wall frames 10 are shipped to a construction site already assembled, the possibility of miscalculation or incorrect connection in the field is reduced. In addition, the boxed wall frame can be dropped into a building and secured in place without requiring field welding. The boxed wall frame 10 is simply bolted into place in the building.

Figure 14:
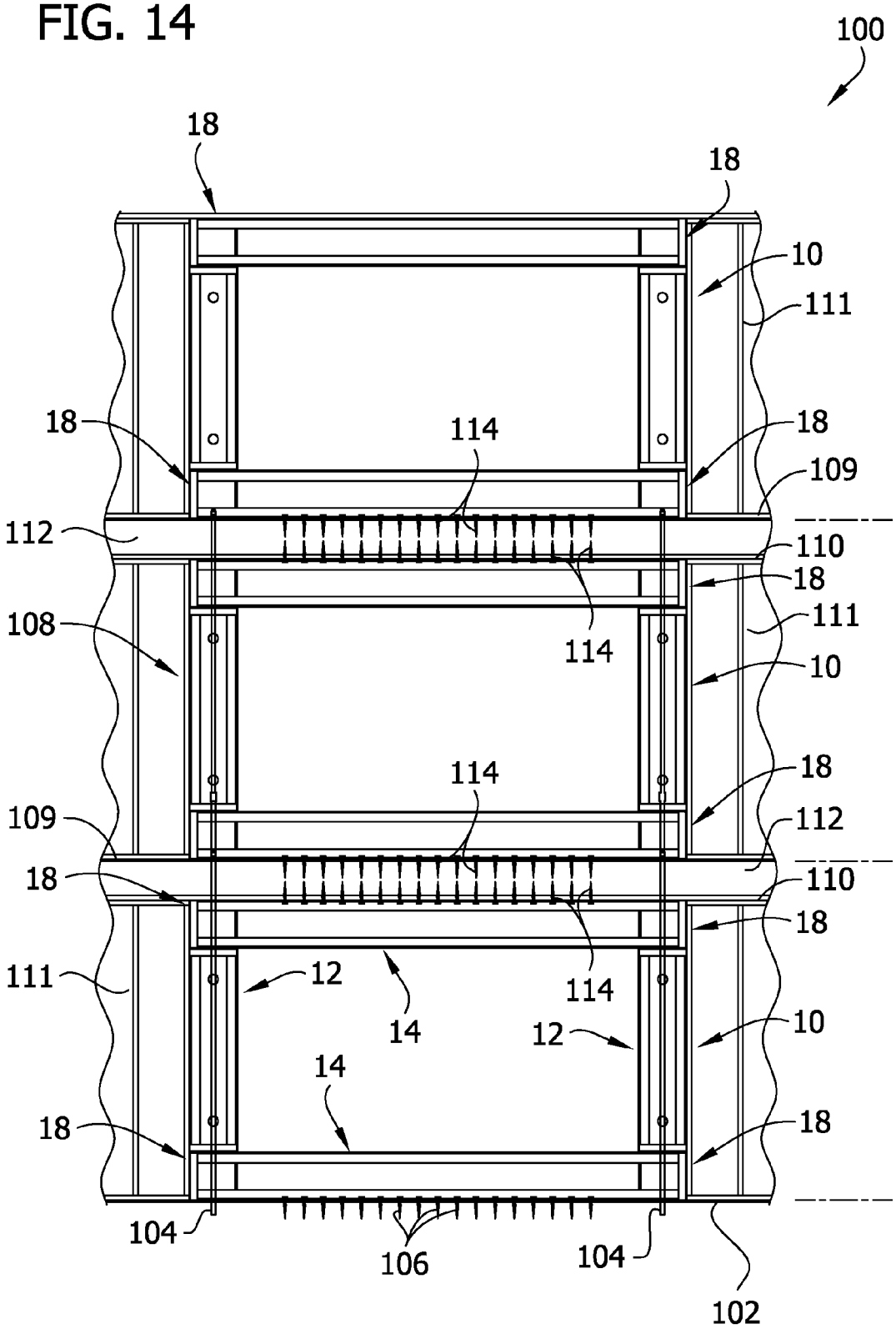
FIG. 14 is a fragmentary front elevation of a multi-story boxed wall system according to the present invention.

In use, each boxed wall frame 10 is placed in position on an outside wall of a building 100. On the first level of the building 100, the boxed wall frame 10 is positioned to contact and engage the foundation 102 of the building. For example, as seen in FIG. 1, in an open boxed wall frame, the bottom of each column 12 is attached (e.g., fixed or pinned) to the foundation 102. As seen in FIG. 14, in a closed boxed wall frame, the bottom beam 14 is attached to the foundation 102. A tie-down rod 104 is attached to the foundation 102 of the building frame and extends upward to attach to the boxed wall frame 10. As illustrated, a tie-down rod 104 is attached to each side of the boxed wall frame 10. The tie-down rods 104 are configured to resist overturning forces on the building. The overturning forces are transferred into the foundation 102 by the tie-down rods 104. The tie-down rods are configured and positioned so there is no fixity at the end of the closed boxed wall frame (i.e., the panel zone can rotate without transferring rotation into the wood floor system of the building). The tie-down rods 104 extend from the foundation 102 all the way up to the bottom of the top level of the building 100 (FIG. 14). Preferably, the tie-down rods 104 are continuous rods with shrink compensating devices to compensate for shrinking of the wood floor framing in the building. In addition, in the closed boxed wall frame configuration, bolts 106 attach the bottom beam 14 to the foundation 102.

In a multi-level building, multiple boxed wall frames 10 can be used to form a multi-story boxed wall system 108 for increasing the resistance of the building 100 including the boxed wall system to lateral forces acting in the plane of interior or exterior walls. The multi-story boxed wall system 108 includes the boxed wall frame 10 attached to the foundation 102, as described above. Preferably, each boxed wall frame 10 on an upper level is aligned with a boxed wall frame on the ground floor. In one embodiment, the multi-story boxed wall system can be incorporated into a structure 100 including multiple (e.g., three) stories of lumber walls. Each lumber wall includes a bottom plate 109, a top plate 110 and studs 111. Between the first and second stories and also the second and third stories is wood floor framing 112. Lag screws 114 attach the boxed wall frames 10 of the second and third stories to the wood floor framing 112. Preferably, the lag screws 114 are positioned in only the center two-thirds of each beam 14. The lag screws 114 transfer shear forces into the wood structure of the building. It will be understood that the walls do not have to be made of lumber (e.g., metal studs and plates may be used), and that the interconnection of the boxed wall frames 10 to the walls may be other than described within the scope of the present invention.

As illustrated, preferably the boxed wall frames 10 on each level of the building are generally aligned. The boxed wall frames can increase in size (e.g., be made of heavier gauge steel, or with a wider beam 14 and/or column 12) toward the bottom of the building, as the bottom frames must withstand larger forces. Both the shear forces and the overturning forces on the building 100 are transferred to the foundation 102.

The boxed wall frame 10 as described above offers several advantages in the construction of single or multi-level residential buildings. Because these buildings are smaller than commercial buildings (e.g., about 1-5 stories) and are wooden structures, typical moment frames utilizing heavy gauge steel are not appropriate. Moment frames previously were not made from light gauge steel because of the low bending capacity of the light gauge steel. Plywood shear walls are costly and labor intensive, and they are also subject to multiple installation errors (e.g., overdriving screws/nails into sheathing that is supposed to yield) that cause variable and unreliable performance. In addition, the necessity for shear walls in the buildings limits where windows can be placed.

The boxed wall frames 10 as described above are made of light gauge steel, making them appropriate for smaller wooden structures. They can be prefabricated, thereby eliminating installation errors and reducing or eliminating variability in performance. They are easily installed as they must be simply bolted into place, with no field welding required. They permit the addition of windows anywhere in the building because of the open frame configuration that is strong enough to resist bending or buckling of beams.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A beam-to-column joint comprising:

a beam including first and second longitudinal ends;

a panel zone located at the first end of the beam, the panel zone including a top, a bottom, a yielding member, and reinforcing structure at least partially bounding the yielding member, the reinforcing structure being configured to concentrate stresses to within the yielding member; and a column including a bottom end and a top end, the top end of the column being attached to the bottom of the panel zone;

wherein the panel zone is configured to resolve external lateral forces on the beam and column into shear force in the yielding member so that the yielding member will fail prior to failure of the beam and column.

2. The beam-to-column joint of claim 1 wherein the yielding member comprises a panel, the reinforcing structure comprising a first stiffener located adjacent an inner side of the column and extending upwardly from the column, the first stiffener being secured to the panel.

3. The beam-to-column joint of claim 2 wherein the panel zone reinforcing structure further comprises a second stiffener located adjacent an outer side of the column and extending upwardly from the column, the second stiffener being secured to the panel.

4. The beam-to-column joint of claim 3 wherein the panel zone reinforcing structure further comprises a third stiffener located above the column and extending in a direction between the first and second stiffeners, the third stiffener being secured to the panel.

5. The beam-to-column joint of claim 4 wherein the panel zone reinforcing structure further comprises a fourth stiffener located above the column, extending in a direction between the first and second stiffeners and spaced vertically from the third stiffener, the fourth stiffener being secured to the panel.

6. The beam-to-column joint of claim 5 wherein the panel zone is connected to the column by at least one bolt extending through the third stiffener.

7. The beam-to-column joint of claim 6 wherein the panel zone is connected to the column by at least two bolts extending through the third stiffener.

8. The beam-to-column joint of claim 7 further comprising a column stiffener, the bolts connecting the panel zone to the column extending through the column stiffener.

9. The beam-to-column joint of claim 1, wherein the beam comprises:

a rear wall;

top and bottom walls extending generally perpendicular from the rear wall;

top and bottom front wall portions extending generally perpendicular from the respective top and bottom walls in opposed facing relationship to the rear wall; and an open interior defined by the rear wall, the top and bottom walls, and the top and bottom front wall portions.

10. The beam-to-column joint of claim 9 further comprising wall stiffeners secured to the top and bottom walls of the beam and secured to the panel zone.

11. The beam-to-column joint of claim 10 wherein the yielding member of the panel zone constitutes an end portion of the rear wall of the beam.

12. The beam-to-column joint of claim 9 further comprising connectors attaching the panel zone to the first longitudinal end of the beam.

13. The beam-to-column joint of claim 12 further comprising a beam stiffener secured to the rear wall of the beam, a stiffener secured to the panel zone and bolts extending through the beam stiffener and the panel zone stiffener.

14. A boxed wall frame comprising:

first and second columns extending generally parallel to each other in spaced relation;

first and second panel zones, bottoms of the panel zones being attached to the respective first and second columns at top ends thereof, each of the panel zones including a yielding member and reinforcing structure at least partially bounding the yielding member, the reinforcing structure being configured to concentrate stresses to within the yielding member; and a beam including a beam section extending between the first and second panel zones and generally perpendicular to the first and second columns;

wherein the panel zones are each configured to resolve external lateral forces on the columns and beam into shear force in the panel zones so that the yielding members will yield prior to significant yielding of the beam and the columns.

15. The boxed wall frame of claim 14 wherein each yielding member comprises a panel, the reinforcing structure of each panel zone comprising a first stiffener located adjacent an inner side of the respective column and extending upwardly from the respective column, the first stiffener being secured to the panel.

16. The boxed wall frame of claim 15 wherein the reinforcing structure of each panel zone further comprises a second stiffener located adjacent an outer side of the respective column and extending upwardly from the respective column, the second stiffener being secured to the panel, a third stiffener located above the respective column and extending in a direction between the first and second stiffeners, the third stiffener being secured to the panel, and a fourth stiffener located above the respective column, extending in a direction between the first and second stiffeners and spaced vertically from the third stiffener, the fourth stiffener being secured to the panel.

17. The boxed wall frame of claim 14 wherein the boxed wall frame comprises a first boxed wall frame, and further in combination with a second boxed wall frame, the second boxed wall frame comprising:

first and second columns extending generally parallel to each other in spaced relation;

first and second panel zones attached to the respective first and second columns at top ends thereof, each of the panel zones including a yielding member and reinforcing structure at least partially bounding the yielding member, the reinforcing structure being configured to concentrate stresses to within the yielding member; and a beam including a beam section extending between the first and second panel zones and generally perpendicular to the first and second columns;

wherein the panel zones are each configured to resolve external lateral forces on the columns and beam into shear force in the panel zones so that the yielding members will yield prior to significant yielding of the beam and the columns;

and wherein the combination further comprises at least one tie-down rod configured to extend between and connect the first and second boxed wall frames to each other.

18. A beam-to-column joint comprising:

a beam including first and second longitudinal ends;

a panel zone located at the first end of the beam, the panel zone including a yielding member and reinforcing structure at least partially bounding the yielding member, the reinforcing structure being configured to concentrate stresses to within the yielding member; and a column including a bottom end and a top end, the top end of the column being attached to the panel zone;

wherein the panel zone is configured to resolve external lateral forces on the beam and column into shear force in the yielding member so that the yielding member will fail prior to failure of the beam and column;

wherein the yielding member comprises a panel, the reinforcing structure comprising a first stiffener located adjacent an inner side of the column and extending upwardly from the column, the first stiffener being secured to the panel.

* * * * *